US006403295B1

(12) United States Patent
Urabe

(10) Patent No.: US 6,403,295 B1
(45) Date of Patent: Jun. 11, 2002

(54) SILVER HALIDE PHOTOGRAPHIC EMULSION AND PROCESS FOR PREPARING THE SAME

(75) Inventor: Shigeharu Urabe, Minami Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/657,935

(22) Filed: Sep. 8, 2000

(30) Foreign Application Priority Data

Sep. 9, 1999 (JP) ..... 11-255799

(51) Int. Cl.[7] ..... G03C 1/005; G03C 1/494
(52) U.S. Cl. ..... 430/567; 430/569
(58) Field of Search ..... 430/567, 569

(56) References Cited

U.S. PATENT DOCUMENTS 4,399,215 A * 8/1983 Wey ..... 430/567
4,684,607 A * 8/1987 Maskasky ..... 430/567
5,733,715 A * 3/1998 Verbeeck et al. ..... 430/567
5,965,343 A * 10/1999 Nishimura ..... 430/567
6,087,085 A * 7/2000 Elst ..... 430/567
6,277,550 B1 * 8/2001 Elst et al. ..... 430/567

FOREIGN PATENT DOCUMENTS

EP 0 754 964 A1 1/1997

* cited by examiner

*Primary Examiner*—Geraldine Letscher
(74) *Attorney, Agent, or Firm*—Sughrue Mion, PLLC

(57) ABSTRACT

The present invention provides a silver halide emulsion comprising triangular tabular grains having an extremely small thickness, an extremely high aspect ratio and (111) face as a main plane. A novel silver halide photographic emulsion is provided comprising triangular tabular grains having (111) face as a main plane and a silver bromide content of 70 mol-% or more incorporated therein in a proportion of 60% or more of all silver halide grains contained therein as calculated in terms of projected area, the triangular tabular grains each having a thickness of less than 0.05 $\mu$m and an equivalent circle diameter of 0.6 $\mu$m or more as calculated in terms of circle.

4 Claims, 1 Drawing Sheet

SILVER HALIDE PHOTOGRAPHIC EMULSION AND PROCESS FOR PREPARING THE SAME

FIELD OF THE INVENTION

The present invention relates to a silver halide photographic emulsion and a process for preparing the photographic emulsion. More particularly, the present invention relates to a silver halide photographic emulsion comprising triangular tabular grains having an extremely small thickness and a high aspect ratio.

BACKGROUND OF THE INVENTION

Tabular silver halide grains (hereinafter referred to as "tabular grains") have the following photographic properties.

(1) The ratio of surface area to volume (hereinafter specific surface area) of tabular silver halide grains is great. Further, tabular silver halide grains can adsorb a large amount of a sensitizing dye on the surface thereof. Therefore, tabular silver halide grains exhibit a relatively high spectral sensitization sensitivity than intrinsic sensitivity.

(2) When an emulsion comprising tabular grains is applied to a support and dried, these tabular grains are oriented parallel to the surface of the support. Therefore, a thin coating layer can be formed. The resulting photographic light-sensitive material exhibits a good sharpness.

(3) In X-ray photographic system, when a sensitizing dye is added to tabular grains, silver halide crossover light can be drastically reduced, making it possible to inhibit the deterioration of image quality.

(4) Tabular grains scatter little light, making it possible to obtain an image having a high resolving power.

(5) Tabular grains have a low sensitivity to blue light. Therefore, when tabular grains are incorporated in a green-sensitive layer or red-sensitive layer, an emulsion free of yellow filter can be used.

Thus, tabular grains have many advantages and hence have heretofore been incorporated in commercially available high sensitivity photographic light-sensitive materials. JP-B-6-44132 (The term "JP-B" as used herein means an "examined Japanese patent publication") and JP-B-5-16015 disclose an emulsion of tabular grains having an aspect ratio of 8 or more. The term "aspect ratio" as used herein means the ratio of diameter to thickness of tabular grain. The term "diameter of grain" as used herein means the diameter of the circle having the same area as the projected area of grain determined under microscope or electron microscope. The term "thickness of grain" as used herein means the distance between two parallel main planes constituting tabular silver halide grain.

JP-B-4-36374 discloses a color photographic light-sensitive material having improvements in sharpness, sensitivity and graininess obtained by incorporating tabular grains having a thickness of less than 0.3 $\mu$m and a diameter of 0.6 $\mu$m or more in at least one of green-sensitive emulsion layer and red-sensitive emulsion layer.

In recent years, however, silver halide photographic materials have had higher sensitivity and smaller format. It has thus keenly been desired to provide color photographic light-sensitive materials having higher sensitivity and better image quality. Therefore, an emulsion of silver halide grains having higher sensitivity and better graininess has been required. However, the conventional emulsion of tabular silver halide grains leave something to be desired in meeting these requirements. Further improvements in properties have been required.

As the aspect ratio of tabular grains is increased, the specific surface area of the grains is increased, making the best use of the advantages of tabular grains. In other words, a greater amount of a sensitizing dye can be adsorbed by a greater surface area to increase the absorption of light per grain, making it possible to obtain a high sensitivity. Thus, studies have heretofore been made of preparation of thinner tabular grains. JP-B-5-12696 discloses a process for preparing thin tabular grains involving the use of a gelatin rendered ineffective by oxidizing methionine group contained therein as a dispersant. JP-A-8-82883 (The term "JP-A" as used herein means an "unexamined published Japanese patent application") discloses a process for preparing thin tabular grains involving the use of a gelatin having amino group and methionine group rendered ineffective as a dispersant. JP-A-10-148897 discloses a process for preparing thin tabular grains involving the use of a gelatin having amino group chemically modified and at least two carboxyl groups incorporated therein as a dispersant.

It has been well-known that tabular grains having (111) face as a main plane include triangular tabular grain, hexagonal tabular grain and tabular grain having a shape intermediate therebetween. The provision of tabular grains having a uniform shape has been the target of past studies in quest of excellent photographic properties such as higher sensitivity and higher gradation. For the details of hexagonal tabular grains having (111) face as a main plane, reference can be made to JP-B-5-61205. Referring to triangular tabular grains having (111) face as a main plane, on the other hand, JP-A-3-238443 discloses that an emulsion comprising tabular grains in a proportion of 50% or more in all grains as calculated in terms of projected area contains monodisperse triangular tabular grains.

It is merely described in examples that the proportion of triangular tabular grains in all grains contained in the emulsion as calculated in terms of projected area falls less than 30%. EP 754964A1 discloses an emulsion comprising tabular silver halide grains having a thickness of less than 0.3 $\mu$m and an equivalent circle diameter of 0.6 $\mu$m or more as calculated in terms of circle in a proportion of at least 30% of all grains as calculated in terms of projected area. The above described publication discloses an example involving the preparation of triangular tabular grains using silica sol as a dispersant in the presence of a phosphonium salt. However, it is described that the triangular tabular grains account for 53 at maximum by number or 66 at maximum by area and exhibit an average thickness of 0.08 $\mu$m at minimum and a maximum aspect ratio of 18. As a result, the proportion of triangular tabular grains is still low, and the thickness of tabular grains is not sufficient yet.

SUMMARY OF THE INVENTION

It is therefore an object of the present invention to provide a silver halide emulsion comprising triangular tabular grains having an extremely small thickness, an extremely high aspect ratio and (111) face as a main plane.

The foregoing object of the present invention will become apparent from the following detailed description and examples.

The foregoing object of the present invention is accomplished by the following aspects of the present invention.

(1) A silver halide photographic emulsion comprising triangular tabular grains having (111) face as a main plane and a silver bromide content of 70 mol-% or more incorporated therein in a proportion of 60% or more of all silver halide grains contained therein as calculated in terms of projected area, the triangular tabular grains each having a thickness of less than 0.05 μm and an equivalent circle diameter of 0.6 μm or more as calculated in terms of circle.

(2) A process for preparing a silver halide photographic emulsion according to the above item (1) which comprises steps of nucleation, ripening and growth, wherein at least one of compounds represented by formulae (I), (II) and (III) is not present during nucleation but is present during ripening and growth:

(I)

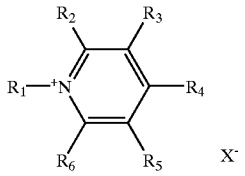

wherein $R_1$ represents an alkyl group, alkenyl group or aralkyl group; $R_2$, $R_3$, $R_4$, $R_5$ and $R_6$ each represent a hydrogen atom or substituent; $R_2$ and $R_3$, $R_3$ and $R_4$, $R_4$ and $R_5$ and $R_5$ and $R_6$ may be condensed to each other, with the proviso that at least one of $R_2$, $R_3$, $R_4$, $R_5$ and $R_6$ represents an aryl group; and $X^-$ represents a counter anion;

(II)

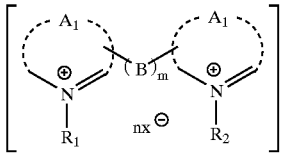

(III)

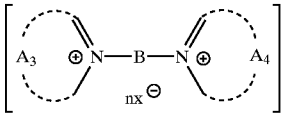

wherein $A_1$, $A_2$, $A_3$ and $A_4$ may be the same or different and each represent a nonmetallic element required to form a nitrogen-containing heterocyclic group; B represents a divalent connecting group; m represents an integer of 0 or 1; $R_1$, and $R_2$ each represent an alkyl group; X represents an anion; and n represents an integer of from 0, or 2, with the proviso that when the compound is an intramolecular salt, n is 0 or 1.

(3) The process for preparing a silver halide photographic emulsion according to the above item (2), which comprises supplying an aqueous solution of a water-soluble silver salt and an aqueous solution of a water-soluble halide into a mixer provided outside a reaction vessel for causing nucleation and/or growth of silver halide grains where they are then mixed to form finely divided silver halide grains, and then immediately supplying the finely divided silver halide grains into the reaction vessel where the nucleation and/or growth of silver halide grains is effected.

(4) The process for preparing a silver halide photographic emulsion according to the above item (2) or (3), wherein at least one of compounds represented by formulae (I), (II) and (III) is continuously supplied into the reaction vessel during the growth of grains.

BRIEF DESCRIPTION OF THE DRAWING

By way of example and to make the description more clear, reference is made to the accompanying drawing in which.

DETAILED DESCRIPTION OF THE INVENTION

Figure 1:
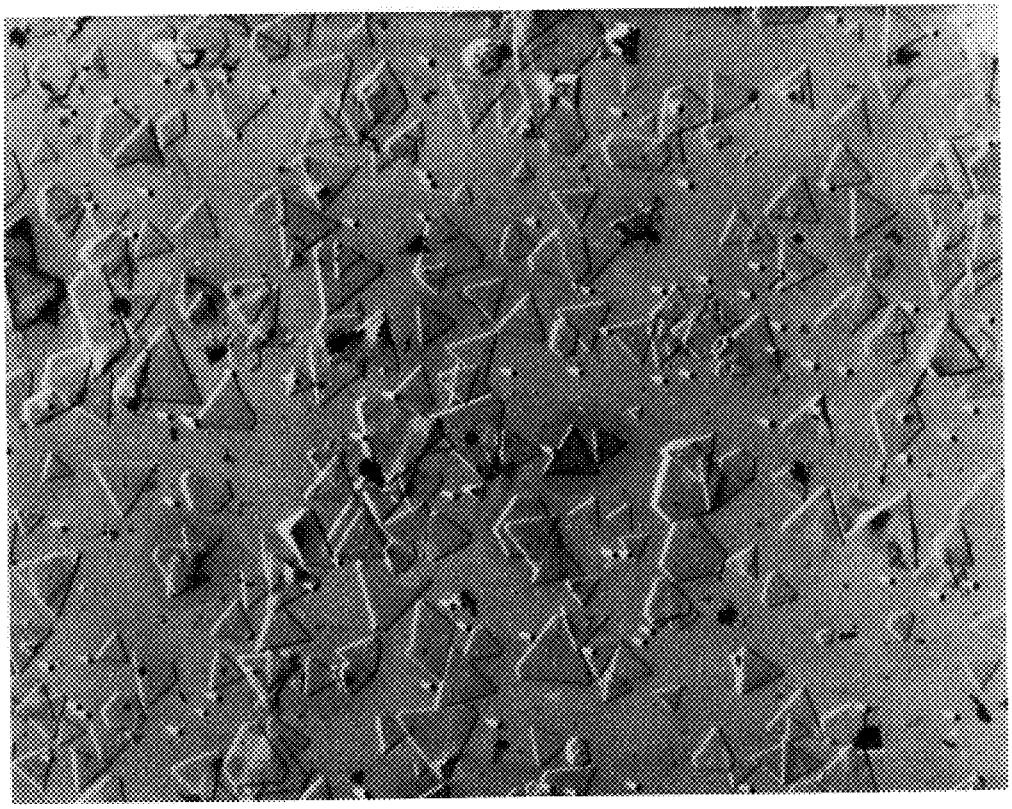
FIG. 1 is an electron micrograph illustrating the structure of silver halide grains constituting Emulsion 1-A of the present invention where the diameter of spherical latex is 0.2 μm.

The term "triangular tabular silver halide grain (hereinafter referred to as "triangular tabular grain")" as used herein means a grain having two opposing parallel main planes the diameter of which as calculated in terms of circle (diameter of circle having the same area as the projected area of the main plane: equivalent circle diameter) are each 200 or more times the distance between the main planes (i.e., grain thickness). The ratio of equivalent circle diameter to thickness of triangular tabular grain of the present invention (aspect ratio) is preferably from 30 to 200, more preferably from 50 to 200. The average aspect ratio of all triangular tabular grains in the emulsion is preferably from 30 to 200, particularly from 50 to 200. The average aspect ratio can be obtained by averaging the aspect ratio of all triangular tabular grains. It can be also obtained simply as the ratio of average diameter to average thickness of all triangular tabular grains.

The diameter as calculated in terms of circle (i.e., equivalent circle diameter) of the triangular tabular grain of the present invention is from 0.6 μm to 20 μm, preferably from 0.8 μm to 20 μm. The thickness of the triangular tabular grain of the present invention is less than 0.05 μm, preferably less than 0.04 μm, more preferably from 0.01 μm to 0.03 μm.

The coefficient of dispersion of equivalent circle diameter (as calculated in terms of circle) and thickness of triangular tabular grains in the emulsion of the present invention are each preferably 30% or less, more preferably 20% or less, particularly 15% or less.

The measurement of the grain diameter and grain thickness of the present invention can be accomplished by taking electron micrograph of grains as disclosed in U.S. Pat. No. 4,434,226. In some detail, for the measurement of the thickness of a grain, the grain is vapor-deposited with a metal in oblique incident direction together with a latex as a reference. The length of the resulting shadow is then measured on the electron micrograph. From the measurements can be easily calculated the thickness of the grain with the length of the shadow of the latex as a reference.

The main planes of a tabular grain can be roughly divided into two planes, i.e., (111) face and (100) face. The triangular tabular grain of the present invention is a tabular grain having at least one twinning plane which is (111) face wherein (111) face parallel to the twinning plane acts as a main plane. The term "twinning plane" as used herein means one of two (111) faces which are mirror images of each other with respect to ions in all lattices. Examples of the triangle in the definition of triangular tabular grain herein include complete triangle and hexagon in which the ratio of adjacent long side and short side is 4 or more. Even a hexagonal tabular grain which is not symmetrical in three radial directions is included in the definition of triangular tabular grain herein so far as the ratio of average of three sets of long side to average of three sets of short side is 4 or more.

In the preparation of the triangular tabular grains of the present invention, it is preferred that finely divided silver halide grains be supplied into the reaction vessel holding an aqueous solution of protective colloid instead of an aqueous solution of silver salt and an aqueous solution of halide to cause nucleation and/or growth. Referring to this method, its technique is disclosed in U.S. Pat. No. 4,879,208, JP-A-1-183644, JP-A-2-4435, JP-A-2-43535, and JP-A-2-68538. In order to supply iodine ion during the formation of tabular grains, an emulsion of finely divided silver iodide grains (grain diameter: 0.1 μm or less, preferably 0.06 μm or less) may be added. In order to supply finely divided silver iodide grains, a preparation process as disclosed in U.S. Pat. No. 4,879,208 is preferably used. The nucleation and/or grain growth by the addition of finely divided grains is preferably carried out by a process as disclosed in JP-A-10-239787 and JP-A-11-76783 which comprises supplying into a reaction vessel finely divided silver halide grains prepared by rotating an agitating blade having no rotating shaft penetrating the agitating bath to prepare silver halide grains.

The halogen composition of the triangular tabular grains is silver bromoiodide, silver bromochloroiodide or silver bromochloride having a silver bromide content of 70 mol-% or more. The structure of the triangular tabular grains of the present invention with respect to halogen composition can be identified by X-ray diffraction, EPMA (also referred to as "XMA") process (process which comprises scanning silver halide grains with electron ray to detect silver halide composition), ESCA (process which comprises irradiating grains with X-ray to cause emission of photoelectron which is then subjected to spectroscopy), etc. in combination.

The compound represented by formula (I), (II) or (III), which is preferably used to prepare (111) main plane type tabular grains in the present invention, will be further described hereinafter. In formula (I), $R_1$ is preferably a $C_{1-20}$ straight-chain, branched or cyclic alkyl group (e.g., methyl, ethyl, isopropyl, t-butyl, n-octyl, n-decyl, n-hexadecyl, cyclopropyl, cyclopentyl, cyclohexyl), $C_{2-20}$ alkenyl group (e.g., allyl, 2-butenyl, 3-pentenyl) or $C_{7-20}$ aralkyl group (e. g. , benzyl, phenetyl). The groups represented by $R_1$ may be substituted. Examples of substituents on these groups include substitutable groups represented by $R_2$ to $R_6$ described below.

R2, R3, R4, R5 and R6 may be the same or different and each represent a hydrogen atom or a group which can substitute for hydrogen atom. Examples of the group which can substituted for hydrogen atom include halogen atom, alkyl group, alkenyl group, arakinyl group, aralkyl group, aryl group, heterocyclic group (e.g., pyridyl, furyl, imidazolyl, piperidyl, morpholino), alkoxyl group, aryloxy group, amino group, acylamino group, ureide group, urethane group, sulfonylamino group, sulfamoyl group, carbamoyl group, sulfonyl group, sulfinyl group, alkyloxycarbonyl group, acyl group, acyloxy group, phosphoric acid amide group, alkylthio group, arylthio group, cyano group, sulfo group, carboxyl group, hydroxyl group, phosphono group, nitro group, sulfino group, ammonio group (e.g., trimethylammonio), phosphonio group, and hydrazino group. These groups may be further substituted.

R2 and R3, R3 and R4, R4 and R5, and R4 and R6 may be condensed to each other to form a quinoline ring, isoquinoline ring or acryidine ring.

$X^-$ represents a counter anion. Examples of the counter anion include halogen ion (e.g., chlorine ion, bromine ion), nitric acid ion, sulfuric acid ion, p-toluenesulfonic acid ion, and trifluoromethanesulfonic acid ion.

It is preferred in formula (I) that $R_1$ represent an aralkyl group and at least one of $R_2$, $R_3$, $R_4$, $R_5$ and $R_6$ represent an aryl group.

More preferably, $R_1$ represents an aralkyl group, $R_4$ represents an aryl group, and $X^-$ represents a halogen ion. Examples of these compounds are disclosed as crystal habit controllers 1 to 29 in JP-A-8-227117, but the present invention should not be construed as being limited thereto. Particularly representative examples of crystal habit controllers are the following compounds (1) to (7).

(1)

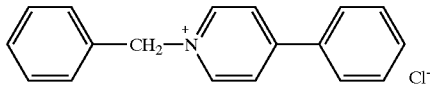

(2)

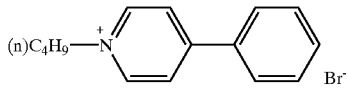

(3)

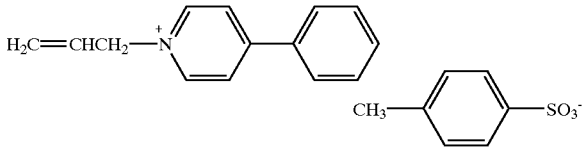

(4)

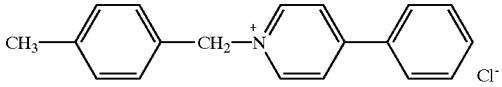

The compounds of formulae (II) and (III) to be used herein will be further described hereinafter.

$A_1$, $A_2$, $A_3$ and $A_4$ each represent a nonmetallic element required to form a nitrogen-containing heterocyclic group which may contain oxygen atom, nitrogen atom or sulfur atom. Benzene rings may be condensed to the nitrogen-containing heterocyclic group. The heterocyclic group formed by $A_1$, $A_2$, $A_3$ and $A_4$ may contain substituents. $A_1$, $A_2$, $A_3$ and $A_4$ may be the same or different. Examples of the substituents on the heterocyclic group include alkyl group, aryl group, aralkyl group, alkenyl group, halogen atom, acyl group, alkoxycarbonyl group, aryloxycarbonyl group, sulfo group, carboxyl group, hydroxyl group, alkoxy group, aryloxy group, amide group, sulfamoyl group, carbamoyl group, ureide group, amino group, sulfonyl group, cyano group, nitro group, mercapto group, alkylthio group, and arylthio group. Preferred examples of $A_1$, $A_2$, $A_3$ and $A_4$ include 5- to 6-membered ring such as pyridine ring, imidazole ring, thiazole ring, oxazole ring, pyrazine ring and pyrimidine ring. Even more desirable among these rings is pyridine ring.

B represents a divalent connecting group. The term "divalent connecting group" as used herein means a divalent connecting group formed by alkylene, arylene, alkenylene, —$SO_2$—, —SO—, —O—, —S—, —CO— and —N($R_2$)— (in which $R_2$ represents an alkyl group, aryl group or hydrogen atom), singly or in combination. Preferred examples of B include alkylene and alkenylene.

$R_1$ and $R_2$ each represent a $C_{1-20}$ alkyl group. $R_1$ and $R_2$ may be the same or different.

The alkyl group represented by $R_1$ or $R_2$ is a substituted or unsubstituted alkyl group. Examples of the substituents on the alkyl group include those described as substituents of $A_1$, $A_2$, $A_3$ and $A_4$.

Preferably, $R_1$ and $R_2$ each represent a $C_{4-10}$ alkyl group. More preferably, $R_1$ and $R_2$ each represent a substituted or unsubstituted aryl-substituted alkyl group. X represents an anion such as chlorine ion, bromine ion, iodine ion, nitric acid ion, sulfuric acid ion, p-toluenesulfonate ion and oxalate ion. The suffix n represents an integer of from 0, 1 or 2. When the compound is an intramolecular salt, n is 0 or 1.

Specific examples of the compound represented by formula (II) or (III) are disclosed as Compound Examples 1 to 42 in JP-A-2-32, but the present invention should not be construed as being limited thereto. Particularly preferred examples of the compound of formula (II) or (III) will be given below.

(5)

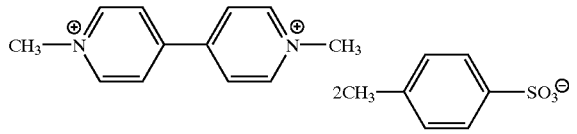

(6)

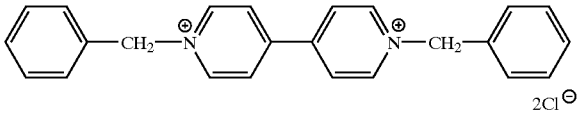

(7)

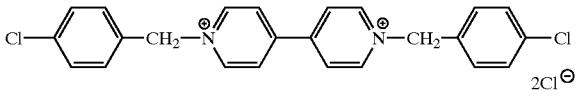

(8)

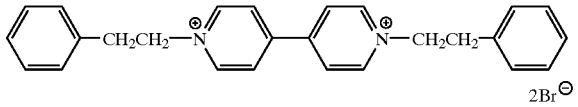

(9)

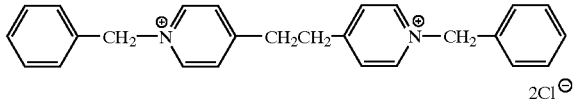

The compound represented by formula (I), (II) or (III) which is preferably used in the present invention shows a marked tendency to be selectively adsorbed by (111) face of silver halide crystal. Such a compound is called (111) crystal phase controller. When such a compound is present during the formation of (111) main plane type tabular grains, the compound is selectively adsorbed on the main plane of the tabular grains to inhibit the growth in the thickness direction of the tabular grains, making it possible to obtain thin tabular grains. JP-A-10-104769 discloses the preparation of thinner tabular grains involving the use of (111) face crystal phase controller during the nucleation (formation of twin crystal). In the present invention, it is preferred that such a (111) crystal phase controller be not present during the nucleation but be present only during ripening and growth.

More specifically, such a (111) twin crystal controller is added after the termination of nucleation or after the subsequent ripening. Further, it is preferred that such a (111) crystal phase controller be present also during the growth of triangular tabular grains. If necessary such a (111) twin crystal controller is preferably added before the beginning of the growth of triangular tabular grains or during the growth of triangular tabular grains. More preferably, such a (111) crystal phase controller is continuously added during the growth of tabular grains. Even more preferably, such a controller is continuously added during the growth of grains in an amount proportional to the increase of the surface area of grains.

The added amount of the compound represented by formula (I), (II) or (III) to be used in the present invention is preferably from $5\times10^{-4}$ to $1\times10^{-1}$ mols, particularly from $1\times10^{-3}$ to $5\times10^{-2}$ mols per mol of silver halide.

As the gelatin to be used herein there may normally be used either alkali-treated or acid-treated gelatin, preferably alkali-treated gelatin. It is particularly preferred that an alkali-treated gelatin which has been subjected to deionization involving the removal of impurity ions or impurities or ultrafiltration be used. Besides the alkali-treated gelatin, there may be used acid-treated gelatin, phthalated gelatin having amino group substutited by substituents, succinated gelatin, trimellited gelatin, phenylcarbamyl gelatin, derivative gelatin such as esterified gelatin in which a carboxyl group of gelatin is substituted with C4-16 aliphatic hydrocarbon, low molecular weight gelatin (specific examples of gelatin having a molecular weight of from 1,000 to 80,000 include enzymatically decomposed gelatin, gelatin hydrolyzed with acid and/or alkali, and thermally decomposed gelatin), high molecular weight gelatin (molecular weight: 110,000 to 300,000), gelatin having a methionine content of 50 $\mu$mol/g or less, gelatin having a tyrosine content of 30 $\mu$mol/g or less, oxidized gelatin, and gelatin having methionine inactivated by alkylation. Two or more of these gelatins may be used in admixture. For the details of high molecular weight gelatins, reference can be made to Japanese Patent Application No. 9-345605. The amount of gelatin to be used at the step of forming grains is from 1 to 60 g/mol-silver, preferably from 3 to 40 g/mol-silver. The concentration of gelatin at the chemical sensitization step of the present invention is preferably from 1 to 100 g/mol-silver, more preferably from 1 to 70 g/mol-silver.

The proportion of triangular tabular grains in the emulsion of triangular tabular grains of the present invention is 60% or more, preferably 80% or more, particularly 90% or more of all the silver halide grains in the emulsion as calculated in terms of projected area.

A particularly preferred emulsion is one comprising triangular tabular grains having an average equivalent circle diameter of from 0.8 to 20 $\mu$m as calculated in terms of circle, an average aspect ratio of from 30 to 200 and an average grain thickness of from 0.01 to 0.04 $\mu$m in a proportion of 90% or more of all grains as calculated in terms of projected area.

The emulsion of the present invention may comprise normal tabular grains (e.g., hexagonal tabular grain) in addition to triangular tabular grain incorporated therein preferably in a proportion of 30% or less, particularly 10% or less as calculated in terms of projected area.

The total tabular grains in the emulsion of the present invention have an average equivalent circle diameter of from 0.6 $\mu$m to 20 $\mu$m, preferably from 0.8 $\mu$m to 20 $\mu$m as calculated in terms of circle, an average grain thickness of less than 0.05 $\mu$m, particularly from 0.01 $\mu$m to 0.04 $\mu$m, and an average aspect ratio of from 20 to 200, preferably from 30 to 200, particularly from 50 to 200.

The additives which can be added between the formation of grains and before the coating during the preparation of the silver halide emulsion according to the present invention is not specifically limited. The preparation of the silver halide emulsion can be carried out in combination with all well-known techniques. For the details of these techniques, reference can be made to the following literatures.

In order to accelerate the growth during the crystal growth step or effectively perform chemical sensitization during grain formation and/or chemical sensitization, a silver halide solvent may be used. Examples of the silver halide solvent which can be often used include water-soluble thiocyanate, ammonia, thioether, and thiourea. Specific examples of these silver halide solvents include thiocyanates as disclosed in U.S. Pat. Nos. 2,222,264, 2,448,534 and 3,320,069, ammonia, thioether compounds as disclosed in U.S. Pat. Nos. 3,271,157, 3,574,628, 3,704,130, 4,297,439 and 4,276,347, thione compounds as disclosed in JP-A-53-144319, JP-A-53-82408, and JP-A-55-77737, amine compounds as disclosed in JP-A-54-100717, thiourea derivatives as disclosed in JP-A-55-2982, imidazoles as disclosed in JP-A-54-100717, and substituted mercaptotetrazoles as disclosed in JP-A-57-202531.

The preparation of the silver halide emulsion to be used in the present invention can be accomplished by any well-known method. In some detail, an aqueous solution of silver salt and an aqueous solution of halide are supplied into a reaction vessel having an aqueous solution of gelatin with efficient stirring. For the details of this preparation method, reference can be made to P. Glafkides, "Chemie et Physique Photographique", Paul Monel, 1967, G. F. Duffin, "Photographic Emulsion Chemistry", The Focal Press, 1966, V. L. Zelikman et al, "Making and Coating Photographic Emulsion", The Focal Press, 1964, etc. In some detail, any of acid method, neutral method and ammonia method may be used. The reaction of the soluble silver salt with the soluble halide can be accomplished by single jet process or double jet process, singly or in combination.

As one of the double jet processes there may be used a so-called controlled double jet process which comprises keeping constant the pAg value of the liquid phase in which silver halide is formed. It is preferred to expedite the growth of silver halide grains to an extent such that the critical supersaturation cannot be exceeded by using a method disclosed in British Patent 1,535,016, JP-B-48-36890, and JP-B-52-16364 which comprises changing the addition rate of an aqueous solution of silver nitrate or halogenated alkali according to the grain growth rate or a method disclosed in U.S. Pat. No. 4,242,445 and JP-A-55-158124 which comprises changing the concentration of an aqueous solution. These methods can be preferably used because they cause no re-nucleation and thus allow uniform growth of silver halide grains.

A method is preferably used which comprises supplying previously prepared finely divided grains into the reaction vessel instead of supplying the silver salt solution and the halide solution so that nucleation and/or grain growth occurs to obtain silver halide grains. For the details of this technique, reference can be made to JP-A-1-183644, JP-A-1-183645, U.S. Pat. No. 4,879,208, JP-A-2-44335, JP-A-2-43534, and JP-A-2-43535. In accordance with this method, the distribution of halogen ions in the emulsion grain crystal can be made completely uniform, making it possible to obtain desired photographic properties.

In the present invention, emulsion grains having various structures maybe used. In some detail, a so-called core/shell double structure grain comprising an inner portion (core) and an outer portion (shell), a triple structure grain as disclosed in JP-A-60-222844, and other multi-layer structures maybe used. In order to allow the emulsion grain to have an inner structure, a grain having a so-called junction structure may be prepared rather than the foregoing encapsulation structure. Examples of these structures are disclosed in JP-A-59-133540, JP-A-58-108526, EP 199290A2, JP-B-58-24772, and JP-A-59-16254.

In order to prepare such a junction structure, a crystal having a composition different from that of the host crystal may be subjected to junction to the host crystal on the edge, corner or plane thereof. Such a junction type crystal may be uniform with respect to halogen composition or may have a core-shell structure. The junction structure, if used, may, of course, have silver halides in combination. If possible, a silver salt compound which has no rock salt structure, such as silver rhodanate and silver carbonate, may be combined to silver halide to form a junction structure.

The silver bromoiodide grain having such a structure, e.g., core-shell structure may have a high silver iodide content in its core and a low silver iodide content in its shell or vice versa. Similarly, the junction structure grain may have a high silver iodide content in its host crystal and a relatively low silver iodide content in its junction crystal or vice versa. In these grain structures, portions having different halogen compositions may have a definite border or may together form a mixed crystal made by their difference in composition or may have a positively continuous structure change therebetween.

The silver halide emulsion to be used in the present invention may be subjected to processing for rounding grains as disclosed in EP-0096727B1 and EP-0064412B1, or surface modification as disclosed in DE-2306447C2 and JP-A-60-221320.

As the chemical sensitization to be effected in the present invention, chalcogen sensitization such as sulfur sensitization, selenium sensitization and tellurium sensitization, noble metal and reduction sensitization may be performed, singly or in combination.

In the sulfur sensitization, labile sulfur compounds are used as sensitizers. Labile sulfur compounds are described in, e.g., P. Grafkides, "Chimie et Physique Photographique (Paul Montel, 1987, the 5th ed.) and Research Disclosure Vol. 307, No. 307105. Examples of labile sulfur compounds employable herein include thiosulfate (e.g., hypo), thioureas (e.g., diphenylthiourea, triethylthiourea, N-ethyl-N'-(4-methyl-2-thiazolyl)thiourea, and carboxymethyltrimethylthiourea), thioamides (e.g., thioacetamide), rhodanines (e.g., diethylrhodanine and 5-benzylidene-N-ethyl-rhodanine), phosphinesulfides (e.g., trimethylphosphinesulfide), thiohydantoins, 4-oxo-oxazolidine-2-thiones, dipolysulfides (e.g., dimorpholinedisulfide, cystine, and hexathiocane-thione), a mercapto compound (e.g., cysteine), polythionate, well-known sulfur compounds such as elemental sulfur, and active gelatin.

In the selenium sensitization, labile selenium compounds are used as sensitizers. Labile selenium compounds described in JP-B-43-13489, JP-B-44-15748, JP-A-4-25832, JP-A-4-109240, JP-A-4-271341, and JP-A-5-40324 can be used.

Specific examples of selenium sensitizers employable herein include colloidal metal selenium, Selenoureas (e.g., N,N-dimethylselenourea, trifluoromethylcarbonyltrimethylselenourea, and acetyltrimethylselenourea), selenoamides (e.g., selenoacetamide and N,N-diethylphenylselenoamide), phosphineselenides (e.g., triphenylphosphineselenide and pentafluorophenyl triphenylphosphineselenide), selenophosphates (e.g., tri-p-tolylselenophosphate and tri-n-butylselenophosphate), selenoketones (e.g., selenobenzophenone), isoselenocyanates, selenocarboxylic acids, selenoesters, and diacylselenides. It is also possible to use unstable selenium compounds as described in JP-B-46-4553 and JP-B-52-34492, such as selenious acid, potassium selenocyanide, selenazoles, and selenides, as selenium sensitizers.

In the tellurium sensitization, labile tellurium compounds are used as sensitizers. Labile tellurium compounds as described in Canadian Pat. No. 800,958, British Pat. Nos. 1,295,462 and 1,396,696, JP-A-4-204640, JP-A-4-271341, JP-A-4-333043 and JP-A-5-303157 can be used. Specific examples of tellurium sensitizers employable herein include telluroureas (e.g., tetramethyltellurourea, N,N'-dimethylethylene tellurourea, and N,N'-diphenylethylenetellurourea), phosphinetellurides (e.g., butyl-diisopropylphosphine telluride, tributylphqsphinetelluride, tributoxyphqsphine telluride, and ethoxydiphenylphosphinetelluride), diacyl (di)tellurides (e.g., bis(diphenylcarbamoyl)ditelluride, bis(N-phenyl-N-methylcarbamoyl)ditelluride, bis(N-phenyl-N-methylcarbamoyl)telluride, and bis(ethoxycarbonyl) telluride), isotellurocyanates, telluroamides, tellurohydrazides, telluroesters (e.g., butylhexyltelluroester), telluroketones (e.g., telluroacetophenone), colloidal tellurium, (di)tellurides, and other tellurium compounds (potassium telluride and telluropentathionate sodium salt).

In the noble metal sensitization, salts of noble metals such as gold, platinum, palladium, and iridium as described in P. Grafkides, "Chimie et Physique Photographique (Paul Montel, 1987, the 5th ed.) and Research Disclosure Vol. 307, NO. 307105 can be used as sensitizers. Gold sensitization is particularly preferable among others. In some detail, gold compounds as described in U.S. Pat. Nos. 2,642,361, 5,049,484 and 5,049,485 may be used in addition to chloroauric acid, potassium chloroaurate, potassium aurithiocyanate, gold sulfide and gold selenide.

For the reduction sensitization, well-known reducing compounds as described in P. Grafkides, "Chimie et Physique Photographique (Paul Montel, 1987, the 5th ed.) and Research Disclosure Vol. 307 can be used as sensitizers. Specific examples of reduction sensitizers employable herein include aminoiminomethanesulfinic acid (also called thiourea dioxide) boran compounds (e.g., dimethylamineboran), hydrazine compounds (e.g., hydrazine, p-tolylhydrazine), polyamine compounds (e.g., diethylenetriamine, triethylenetetramine), stannous chloride, silane compounds, reductones (e.g., ascorbic acid), sulfite, aldehyde compounds, and hydrogen gas. Reduction sensitization may be effected in an atmosphere of high pH or excessive silver ions (so-called silver ripening).

These chemical sensitizations may be effected singly or in combination of two or more thereof. When these chemical sensitizations are effected in combination, it is particularly preferred that chalocogen sensitization and gold sensitization be effected in combination. Reduction is preferably effected during the formation of silver halide grains.

The amount of the chalcogen sensitizer to be used in the present invention depends on the chemical sensitization conditions of the silver halide grains used. In practice, however, it is from $1\times10^{-8}$ to $1\times10^{-2}$ mols, preferably from $1\times10^{-7}$ to $5\times10^{-3}$ mols per mol of silver halide.

The amount of the noble metal sensitizer to be used in the present invention is from about $1\times10^{-7}$ to $1\times10^{-2}$ mols per mol of silver halide. The chemical sensitization conditions of the present invention are not specifically limited. In practice, however, these chemical sensitizations are preferably effected at pAg of from 6 to 11, more preferably from 7 to 10, pH of from 4 to 10 and a temperature of from 40° C. to 95° C., more preferably from 45° C. to 85° C.

EXAMPLE

The present invention will be further described in the following examples, but the present invention should not be construed as being limited thereto.

Example 1

Emulsion of Tabular Silver Bromoiodide Grains

Emulsion 1-A (Invention)

Using the same mixer (inner capacity: 0.5 ml) as shown in FIG. 4 of JP-A-2-213837 in the same system as shown in FIG. 3 of the above described publication, tabular grains were prepared in the following manner. This example shows a method which comprises effecting both nucleation and grain growth in a mixer.

Into a mixer 7 were continuously supplied 500 ml of a 0.021 M aqueous solution of silver nitrate and 500 ml of a 0.028 M aqueous solution of KBr containing 0.1 wt-% of a low molecular weight gelatin (average molecular weight: 40,000) in 20 minutes. The resulting emulsion was then continuously received by a reaction vessel in 20 minutes to obtain 1,000 ml of a nucleic emulsion. During this procedure, the rotary speed of the mixer was 2,000 rpm. (Nucleation)

After the termination of nucleation, to the nucleic emulsion in the reaction vessel were then added 22 ml of a 0.8 M solution of KBr and 300 ml of a 10 wt-% trimellited gelatin containing 0.2 mmols of a crystal phase controller 1 with vigorous stirring. The mixture was heated to a temperature of 75° C. where it was then allowed to stand for 5 minutes. (Ripening)

Thereafter, into the mixer were supplied 1,000 ml of a 0.6 M aqueous solution of silver nitrate and 1,000 ml of a 0.6 M aqueous solution of KBr containing 50 g of a low molecular weight gelatin (average molecular weight: 40,000) and 3 mol-% of KI at a constant flow rate in 56 minutes. The fine grain emulsion produced in the mixer was then continuously supplied into the reaction vessel. During this procedure, the rotary speed of the mixer was 2,000 rpm. At the same time, 150 ml of a 1/50 M solution of the crystal phase controller 1 was continuously supplied into the reaction vessel at a constant flow rate. In the reaction vessel, the agitating blade was rotated at a speed of 800 rpm to make vigorous stirring. (Growth)

During the grain growth, when the added amount of silver nitrate reached 70% of the desired value, $IrCl_6$ was then added to the emulsion in an amount of 8×10-8 mol/mol-Ag to effect doping. Shortly before the termination of grain growth, a solution of yellow prussiate of potash was supplied into the mixer. The yellow prussiate of potash was doped into the grain at a shell portion of 3% (as calculated in terms of added amount of silver) in a local concentration of $3\times10^{-4}$ mol/mol-Ag. After the termination of addition, the emulsion was cooled to a temperature of 35° C., and then rinsed by an ordinary flocculation method. 70 g of lime-treated ossein gelatin was then dissolved in the emulsion. The emulsion was adjusted to pAg 8.7 and pH 6.5, and then stored in a cold dark place. The properties of the tabular grains thus obtained are shown in Table 1.

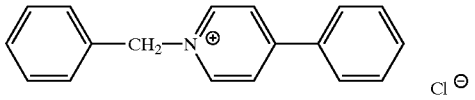

Emulsion 1-B (Comparison)

Emulsion 1-B was prepared in the same manner as Emulsion 1-A except that nucleation was carried out using a mixture of 500 ml of a 0.028 M aqueous solution of KBr containing 0.1 wt-% of a low molecular weight gelatin (average molecular weight: 40,000) and 0.2 mmols of the crystal phase controller 1 and was not followed by the addition of 0.2 mmols of the crystal phase controller 1. The properties of the tabular grains thus obtained are shown in Table 1.

Emulsion 1-C (Comparison)

Emulsion 1-C was prepared in the same manner as Emulsion 1-A except that the addition of 150 ml of a 1/50 M solution of the crystal phase controller 1 was not effected at the growth step. The properties of the tabular grains thus obtained are shown in Table 1.

Emulsion 1-D (Comparison)

Emulsion 1-D was prepared in the same manner as Emulsion 1-A except that the addition of 0.2 mmols of the crystal phase controller 1 was not effected during ripening and the addition of 150 ml of a 1/50 M solution of the crystal phase controller 1 was not effected during growth. The properties of the tabular grains thus obtained are shown in Table 1.

TABLE 1

| Emulsion | Average equivalent circle diameter As calculated in terms of circle (μm) | Average thickness (μm) | Proportion of tabular grains (as calculated in terms of projected area) | Proportion Of triangular tabular grains (as calculated in terms of projected area) |
|---|---|---|---|---|
| 1-A (invention) | 3.0 | 0.023 | 96% | 86% |
| 1-B (comparison) | 2.1 | 0.067 | 82% | 50% |
| 1-C (comparison) | 2.2 | 0.050 | 97% | 20% |
| 1-D (comparison) | 2.1 | 0.055 | 98% | 10% |

In Table 1, the equivalent circle diameter as calculated in terms of circle indicates the diameter of the circle having the same area as the projected area of tabular grain. The proportion of tabular grains indicates the proportion of tabular grains having an aspect ratio of 5 or more in all grains as calculated in terms of projected area. The proportion of triangular tabular grains indicates the proportion of triangular tabular grains in all grains as calculated in terms of projected area. The triangular tabular grain of the present invention has an extremely small thickness. The proportion of the triangular tabular grains of the present invention is extremely high. In Emulsion 1-B steric grains are incorporated therein and thus a proportion of triangular tabular grains is reduced. As is apparent from the results of Emulsions 1-C and 1-D, when a crystal phase controller is not used during growth, the resulting tabular grains have a thickness of greater than 0.05 μm. These emulsions are each subjected to optimum chemical sensitization and spectral sensitization, and then compared in photographic properties. As a result, it was confirmed that Emulsion 1-A is excellent both in sensitivity and fog resistance.

The triangular tabular grains of the present invention have less corners as compared with hexagonal tabular grains and an extremely small thickness. Thus, a latent image can be concentrated on the triangular tabular grains.

Example 2

Emulsion of Tabular Pure Silver Bromide Emulsion 2-A (Invention)

To a solution which had been obtained by supplying 1.0 l of water, 3 g of a low molecular ossein gelatin (average molecular weight: 20,000) and 0.5 g of KBr into a reaction vessel with vigorous stirring to make a solution, and then keeping the solution at 35° C. were added 10 ml of a 0.5 M solution of silver nitrate and 20 ml of a 0.3 M solution of KBr with stirring in 40 seconds. (Nucleation)

To the emulsion were then added 22 ml of a 0.8 M solution of KBr and 300 ml of a 10% solution of trimellited gelatin containing 0.2 mmols of the crystal phase controller 1. The emulsion was then heated to a temperature of $_{75}$° C. in 30 minutes. The emulsion was then ripened at a temperature of 75° C. for 5 minutes. (Ripening)

Thereafter, into a mixer were supplied 1,000 ml of a 0.60 M aqueous solution of silver nitrate, 1,000 ml of an aqueous solution of 50 g of a low molecular weight gelatin (average molecular weight: 20,000) and 0.603 M of KBr and 150 ml of a 1/50 M solution of the crystal phase controller 1 by triple jet process at a constant rate in 56 minutes. The fine emulsion thus produced in the mixer was then continuously supplied into the reaction vessel. During this procedure, the rotary speed of the mixer was 2,000 rpm. In the reaction vessel, the agitating blade was rotated at a speed of 800 rpm to make vigorous stirring. (Growth)

After the termination of addition, the emulsion was cooled to a temperature of 35° C., and then rinsed by an ordinary flocculation method. 70 g of lime-treated ossein gelatin was then dissolved in the emulsion. The emulsion was adjusted to pAg 8.7 and pH 6.5, and then stored in a cold dark place.

Emulsion 2-B (Comparison)

Emulsion 2-B was prepared in the same manner as Emulsion 2-A except that 20 ml of an aqueous solution containing 0.2 mmols of the crystal phase controller 1 was added 1 minute before nucleation and the addition of 0.2 mmols of the crystal phase controller 1 was not effected during ripening after nucleation. The properties of the tabular grains thus obtained are shown in Table 2.

Emulsion 2-C (Comparison)

Emulsion 2-C was prepared in the same manner as Emulsion 2-A except that the addition of 150 ml of a 1/50 M solution of the crystal phase controller 1 was not effected at the growth step. The properties of the tabular grains thus obtained are shown in Table 2.

Emulsion 2-D (Comparison)

Emulsion2-D was prepared in the same manner as Emulsion 2-A except that the addition of 0.2 mmols of the crystal phase controller 1 was not effected during ripening and the addition of 150 ml of a 1/50 M solution of the crystal phase controller 1 was not effected during growth. The properties of the tabular grains thus obtained are shown in Table 2.

Emulsion 2-E (Comparison)

Emulsion2-E was prepared in the same manner as Emulsion 2-A except that the addition of 0.2 mmols of the crystal phase controller 1 was not effected during ripening, the addition of 150 ml of a solution of the crystal phase controller 1 was not effected during growth and 100 ml of a 2.52 M solution of KBr was added before growth. The properties of the tabular grains thus obtained are shown in Table 2.

Emulsion 2-F (Comparison)

Emulsion 2-F was prepared in the same manner as Emulsion 2-A except that the addition of 0.2 mmols of the crystal phase controller 1 was not effected during ripening and 100 ml of a 1/50 M solution of the crystal phase controller 1 was added at a constant flow rate by triple jet process in 39 minutes after 17 minutes from the beginning of the addition of the silver nitrate solution and the halide solution. The properties of the tabular grains thus obtained are shown in Table 2.

Example 3

Emulsion of Pure Tabular Silver Bromide Grains (Comparison)

Emulsion 3-A

To a solution which had been obtained by supplying 1.0 l of water, 3 g of a low molecular ossein gelatin (average molecular weight: 20,000) and 0.5 g of KBr into a reaction vessel with vigorous stirring to make a solution, and then keeping the solution at 35° C. were added 10 ml of a 0.5 M solution of silver nitrate and 20 ml of a 0.3 M solution of KBr with stirring in 40 seconds. (Nucleation)

To the emulsion were then added 22 ml of a 0.8 M solution of KBr and 300 ml of a 10% solution of trimellited gelatin containing 0.2 mmols of the crystal phase controller 1. The emulsion was then heated to a temperature of 75° C. in 30 minutes. The emulsion was then ripened at a temperature of 75° C. for 5 minutes. (Ripening)

Thereafter, into the reaction vessel were continuously supplied 1,000 ml of a 0.60 M aqueous solution of silver nitrate, 1,000 ml of a 0.603 M aqueous solution of KBr and 150 ml of a 1/50 M solution of the crystal phase controller 1 with vigorous stirring by triple jet process at a constant flow rate in 56 minutes. In the reaction vessel, the agitating blade was rotated at a speed of 800 rpm. (Growth)

After the termination of addition, the emulsion was cooled to a temperature of 35° C., and then rinsed by an ordinary flocculation method. 70 g of lime-treated ossein gelatin was then dissolved in the emulsion. The emulsion was adjusted to pAg 8.7 and pH 6.5, and then stored in a cold dark place.

Example 4

Emulsion of Pure Tabular Silver Bromide Grains (Comparison)

Emulsion 4-A

To a solution which had been obtained by supplying 1.0 l of water, 3 g of a low molecular ossein gelatin (average molecular weight: 20,000) and 0.5 g of KBr into a reaction vessel with vigorous stirring to make a solution, and then keeping the solution at 35° C. were added 10 ml of a 0.5 M solution of silver nitrate and 20 ml of a 0.3 M solution of KBr with stirring in 40 seconds. (Nucleation)

To the emulsion were then added 22 ml of a 0.8 M solution of KBr and 300 ml of a 10% solution of trimellited gelatin containing 0.2 mmols of the crystal phase controller 1. The emulsion was then heated to a temperature of 75° C. in 30 minutes. The emulsion was then ripened at a temperature of 75° C. for 5 minutes. (Ripening)

Thereafter, into the reaction vessel were continuously supplied 1,000 ml of a 0.60 M aqueous solution of silver nitrate, 1,000 ml of a 0.603 M aqueous solution of KBr with vigorous stirring by double jet process in 56 minutes. In the reaction vessel, the agitating blade was rotated at a speed of 800 rpm. (Growth)

After the termination of addition, the emulsion was cooled to a temperature of 35° C., and then rinsed by an ordinary flocculation method. 70 g of lime-treated ossein gelatin was then dissolved in the emulsion. The emulsion was adjusted to pAg 8.7 and pH 6.5, and then stored in a cold dark place.

TABLE 2

| Emulsion | Average equivalent circle diameter as calculated in terms of circle (μm) | Average thickness (μm) | Proportion of tabular grains (as calculated in terms of projected area) | Proportion of triangular tabular grains (as calculated in terms of projected area) |
|---|---|---|---|---|
| 2-A (invention) | 2.9 | 0.026 | 94% | 92% |
| 2-B (comparison) | 2.4 | 0.069 | 82% | 50% |
| 2-C (comparison) | 2.2 | 0.051 | 97% | 20% |
| 2-D (comparison) | 2.3 | 0.053 | 98% | 10% |
| 2-E (comparison) | 2.3 | 0.060 | 96% | 75% (*1) |
| 2-F (present invention) | 2.7 | 0.040 | 96% | 70% |
| 3-A (comparison) | 2.9 | 0.036 | 94% | 20% |
| 4-A (comparison) | 2.0 | 0.070 | 96% | 62% (*1) |

(*1) Emulsions 2-E and 4-A comprised a large number of grains which are triangular but have a thickness of greater than 0.05 μm. These grains fall outside the definition of the triangular tabular grain of the present invention.

The various emulsions in Table 2 were each subjected to optimum chemical sensitization and spectral sensitization, and then compared in photographic properties. Emulsions 2-A and 2-F of the present invention are excellent both in sensitivity and fog resistance as compared with the comparative emulsions.

Example 5

Emulsion 1-A of Example 1 was subjected to optimum chemical sensitization and spectral sensitization. The emulsion thus processed was then used as an emulsion to be incorporated in the 3rd layer of Sample 201 in Example 2 of JP-A-9-14623. The emulsion was processed in the same manner as in examples of the above described publication. As a result, good results were obtained.

Emulsion 1-A was subjected to optimum chemical sensitization and spectral sensitization. The emulsion thus processed was then used as an emulsion to be incorporated in the 3rd layer of Sample 110 in Example 2 of JP-A-10-20462. The emulsion was processed in the same manner as in examples of the above described publication. As a result, good results were obtained.

Emulsion 1-A was subjected to optimum chemical sensitization and spectral sensitization. The emulsion thus processed was then used as an emulsion to be incorporated in the 3rd layer of Sample 201 in Example 2 of JP-A-9-146237. The emulsion was processed in the same manner as in examples of the above described publication. As a result, good results were obtained.

In accordance with the present invention, an emulsion of extremely thin triangular tabular grains excellent in sensitivity and fog resistance can be obtained.

While the present invention has been described in detail and with reference to specific embodiments thereof, it will be apparent to one skilled in the art that various changes and modifications can be made therein without departing from the spirit and scope thereof.

What is claimed is:

1. A process for preparing a silver halide photographic emulsion comprising triangular tabular grains having (111) face as a main plane and a silver bromide content of 70 mol-% or more incorporated therein in a proportion of 60% or more of all silver halide grains contained therein as calculated in terms of projected area, said triangular tabular grains each having a thickness of less than 0.05 $\mu$m and an equivalent diameter of 0.6 $\mu$m or more as calculated in terms of circle, which comprises steps of nucleation, ripening and growth, wherein at least one of compounds represented by formulae (I) (II) and (III) is not present during nucleation but is present during ripening and growth:

(I)

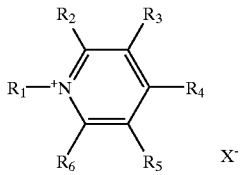

wherein $R_1$ represents an alkyl group, alkenyl group or aralkyl group; $R_2$, $R_3$, $R_4$, $R_5$ and $R_6$ each represent a hydrogen atom or substituent; $R_2$ and $R_3$, $R_3$ and $R_4$, $R_4$ and $R_5$ and $R_5$ and $R_6$ may be condensed to each other, with the proviso that at least one of $R_2$, $R_3$, $R_4$, $R_5$ and $R_6$ represents an aryl group; and X represents a counter anion;

(II)

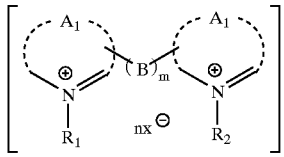

(III)

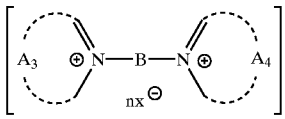

wherein $A_1$, $A_2$, $A_3$ and $A_4$ may be the same or different and each represent a nonmetallic element required to form a nitrogen-containing heterocyclic group; B represents a divalent connecting group; m represents an integer of 0 or 1; $R_1$ and $R_2$ each represent an alkyl group; X represents an anion; and n represents an integer of from 0, 1 or 2, with the proviso that when the compound is an intramolecular salt, n is 0 or 1.

2. The process for preparing a silver halide photographic emulsion as in claim 1, which comprises supplying an aqueous solution of a water-soluble silver salt and an aqueous solution of a water-soluble halide into a mixer provided outside a reaction vessel for causing nucleation and/or growth of silver halide grains where they are then mixed to form finely divided silver halide grains, and then immediately supplying said finely divided silver halide grains into said reaction vessel where the nucleation and/or growth of silver halide grains is effected.

3. The process for preparing a silver halide photographic emulsion as in claim 1, wherein at least one of compounds represented by formulae (I), (II) and (III) is continuously supplied into said reaction vessel during the growth of grains.

4. The process for preparing a silver halide photographic emulsion as in claim 1, wherein said compounds represented by formulae (I), (II) and (III) is used in an amount of from $5\times10^{-4}$ to $1\times10^{-1}$ mol, per mol of silver halide.

* * * * *